US006443614B1

(12) United States Patent
Read

(10) Patent No.: US 6,443,614 B1
(45) **Date of Patent: *Sep. 3, 2002**

(54) WRIST-WORN INSTRUMENT FACE WITH INDICATING ICONS FOR PROGRAMMING

(76) Inventor: John Robert Read, 188 Technology Dr., Suite N, Irvine, CA (US) 92618

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/968,735

(22) Filed: Aug. 28, 1997

(51) Int. Cl.[7] ..... G04B 37/00

(52) U.S. Cl. ..... 368/281; 368/187

(58) Field of Search ..... 368/187, 189, 368/69, 70, 185, 281, 282

(56) References Cited

U.S. PATENT DOCUMENTS 4,896,307 A * 1/1990 Marx et al. ..... 368/70

* cited by examiner

*Primary Examiner*—Bernard Roskoski
(74) *Attorney, Agent, or Firm*—Pedersen & Co., PLLC; Ken J. Pedersen; Barbara S. Pedersen

(57) ABSTRACT

Embodiments of a wrist-worn instrument face display that has dot matrix indicating icons for programming or prompting the instrument. The icons may be single or combinations of symbols, numbers and text. In particular, the icons indicate a function of the instrument, and "point" to a specific function key located near the instrument face to indicate which key is to be pressed, and how many times it is to be pressed, and/or what plurality of keys are to be pressed and in what order, in order to obtain an identified, desired read-out on the instrument face or display. This way, operation of several functions, even ones requiring multiple keystrokes, may be easily accomplished by the user without referring to the operations manual.

1 Claim, 7 Drawing Sheets

WRIST-WORN INSTRUMENT FACE WITH INDICATING ICONS FOR PROGRAMMING

BACKGROUND OF THE INVENTION

1. Field of the Invention.

This invention relates generally to wrist-worn instruments and indicators for personal activities, like watches and personal altitude, cardiac, distance and speed indicators, for example. More specifically, this invention relates to wrist-worn instrument faces or displays which contain indicating icons which assist the user in programming or prompting the instrument.

2. Related Art

U.S. Pat. No. 5,444,671 (Tschannen) discloses a wrist-watch which has communication capability. Received messages may be indicated by display means which are housed in the timepiece.

U.S. Pat. No. 5,185,604 (Nepple et al.) Discloses a wrist-worn paging system with icons indicating that a message has been received and that a message has been missed.

Still, there is a need in the wristwatch industry for a wrist-worn face which has indicating icons for programming and prompting the instrument. This invention addresses that need.

SUMMARY OF THE INVENTION

The invention is a wrist-worn instrument face or display that has dot matrix indicating icons for programming or prompting the instrument. The icons may be single or combinations of symbols, numbers and text. In particular, the icons indicate a function of the instrument, and "point" to a specific function key located near the instrument face to indicate which key is to be pressed, and how many times it is to be pressed, and/or what plurality of keys are to be pressed and in what order, in order to obtain an identified, desired read-out on the instrument face or display. This way, operation of several functions, even ones requiring multiple keystrokes, may be easily accomplished by the user without referring to the operations manual.

DESCRIPTION OF THE PREFERRED EMBODIMENTS

Figure 1A:
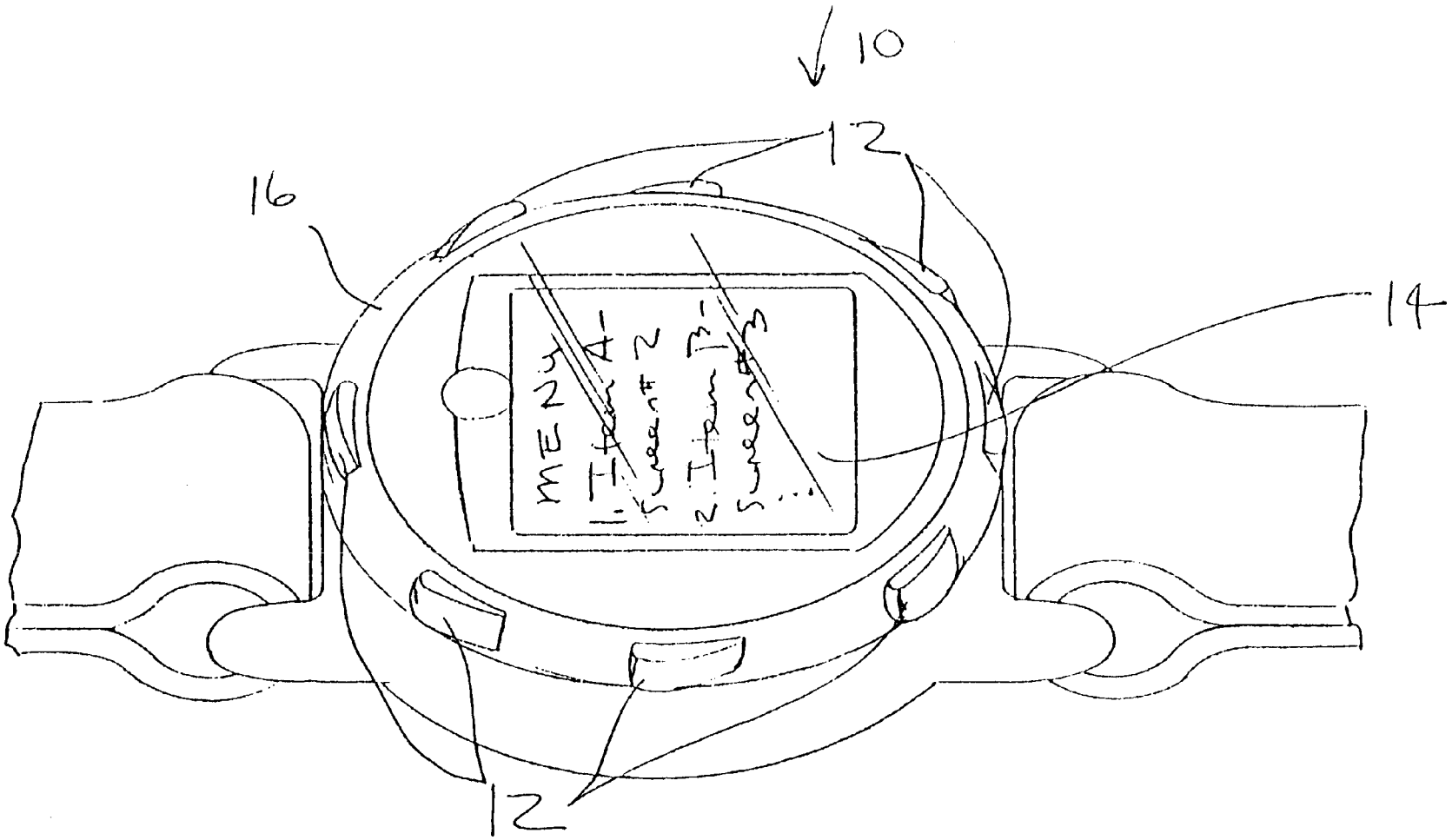
FIGS. 1A–1E are schematic, perspective depictions of one embodiment of the invention in different operation modes.

Referring to FIGS. 1A–1E, there is depicted generally one embodiment, but not the only embodiment, of my invention, wristwatch 10 in different operating modes. Wristwatch 10 has operating keys 12, in this case 8 keys, dispersed evenly around, and close to, the perimeter of watch face 14. In operation, the keys may have a primary function, as well as other, secondary functions. The keys may have names printed near them on the bezel 16 or on the face 14 of the watch to identify the functions of the keys.

For example, some key functions may be:

1. Option key—this key may advance the unit through the main MENU, WATCH FUNCTIONS and HELP screens displayed on watch face 14;
2. Lap key—this key may advance the unit to the next lap in the lap chronograph, interval chronograph and interval timer modes;

3. Chrono key—this key may start and stop the chronographs and timers; and
4. Glo key—this key may activate the display backlight feature for watch face 14.

For example, some of the unit's normal wristwatch functions may be:

Time of Day—Time of day is displayed in either a 12 or 24 hour format. Time of day is shown with the day and the date.

24 Hour Alarm—The unit is equipped with a 24 hour alarm clock that is programmable to the minute.

Day/Date 20 year perpetual calendar—When the user sets the date, the unit automatically programs the day of the week for you.

Backlit Display —The unit is equipped with a brilliant display back light. To activate, the user holds the GLO key for one second. The display backlight automatically stays lit for 5 seconds.

Sleep Mode —If the unit does not receive any input for a period of 5 to 10 minutes, it will enter a sleep mode to reserve battery power. This is totally automatic and cannot be disabled. Pressing any key will restart the watch.

Also, the unit may have capability to operate as a heart rate monitor, of which some functions may be:

Heart Rate Display—Shows instantaneous heart rate in Beats Per Minute (BPM). Heat rate icon (heart symbol) flashes to show heat rate signal from chest strap.

Average Heart Rate Display—Calculates the average heart rate for a workout.

Heart Rate Zone Limits—Allows the user to set upper (240–100 BPM) and lower (40–179 BPM) Heart Rate Zone Limits.

Recovery Heart Rate Limit—Allows the user to set a desired recovery heart rate limit from 40-179 BPM.

Heart Rate Zone—Memory and Recall—Allows the user to store and recall up to 19:59:59 of heart rate data into a target zone. This function tracks the time the user spends above, below and in the Target Heart Rate Zone, as well as the Average Heart Rate for the workout.

Audible Heart Rate Zone Alarm—The unit is equipped with a beeper which informs the user if he/she goes outside of the programmed heart rate zone. The user activates and deactivates the beeper by quickly pressing the GLO key.

Visual Heart Rate Zone Alarm—The unit is also equipped with two small arrows located above the below the flashing heart icon which indicate it the user is above (up arrow) or below (down arrow) the target heart rate zone. This feature is automatic and cannot be disabled.

Also, the unit may have the capability of specialized sports training functions, of which some functions may be:

10-Hour Countdown Timer—The unit is equipped with a count down timer that will sound an alarm at the end of up to a ten hour segment. This feature is also used with the "Timer Interval" feature of the unit.

20 Hour Chronograph Stopwatch—The unit is equipped with a chronograph stopwatch that records time up to 19:59:59, accurate to 1/100 of a second. Starting the chronograph stopwatch also begins storing heart rate information into the Heart Rate Zone Memory.

48 Lap Chronograph Stopwatch—The unit is equipped with a lap chronograph that allows the user to time up to 48 individual segments of workout. The lap chronograph memory will track the following information: Total Workout time, average heart rate for total workout, workout time for each segment sand average hear rate for each segment.

Also, the unit may have the capability of programmable interval training functions, including a lap chronograph stopwatch and countdown timer both with 48 segment memories. Both of these functions are controlled by the user's programmed recovery heart rate and prompt the user through those tough interval workouts. The unit interval training function will track the following information during interval workouts: workout time, average heart rate, and time to recovery heart rate, for the total workout and for each interval segment.

Figure 1B:
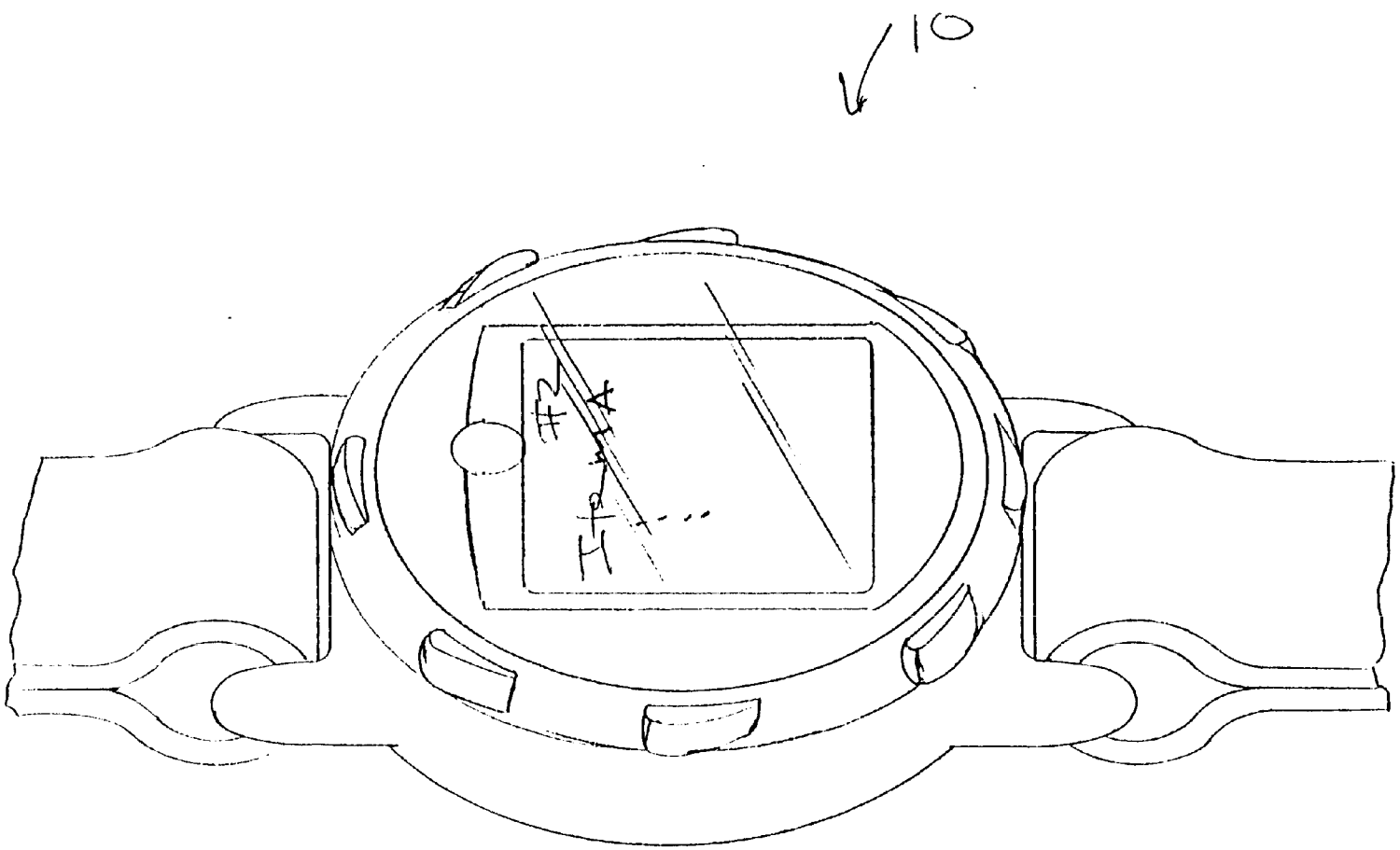
Figure 1:
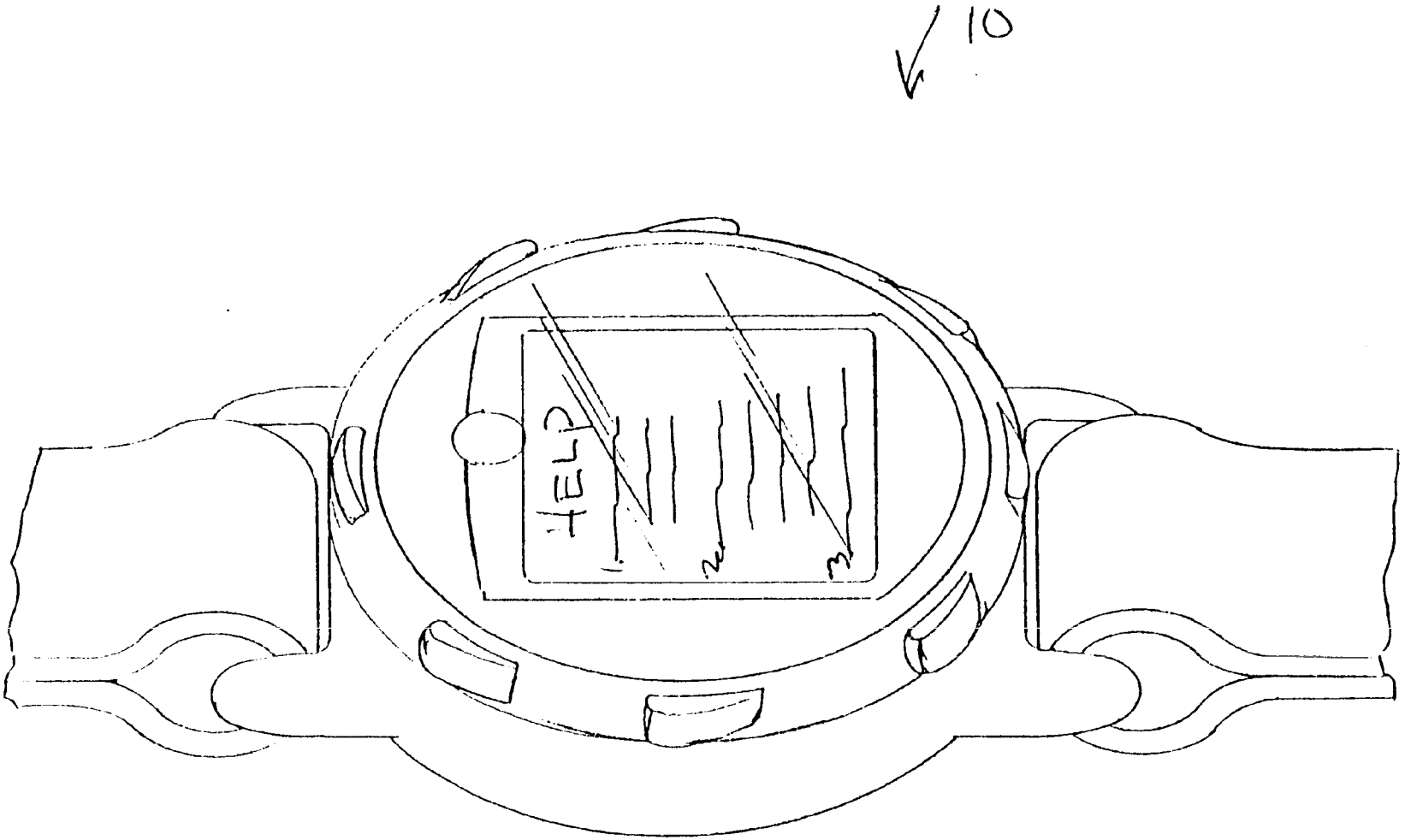

Referring to FIG. 1A, there is depicted a dot matrix display of a "MENU" on the screen in the watch face 14, including listings for Items A and B, etc. In FIG. 1B, there is depicted "ITEM A" as indexed on the MENU screen in FIG. 1A. ITEM A may be, for example, a description of a particular watch function, as described above. In FIG. 1C, there is depicted a "HELP" screen, which screen may include information for diagnosing reasons and solutions for failures of the unit to operate as desired.

Figure 1D:
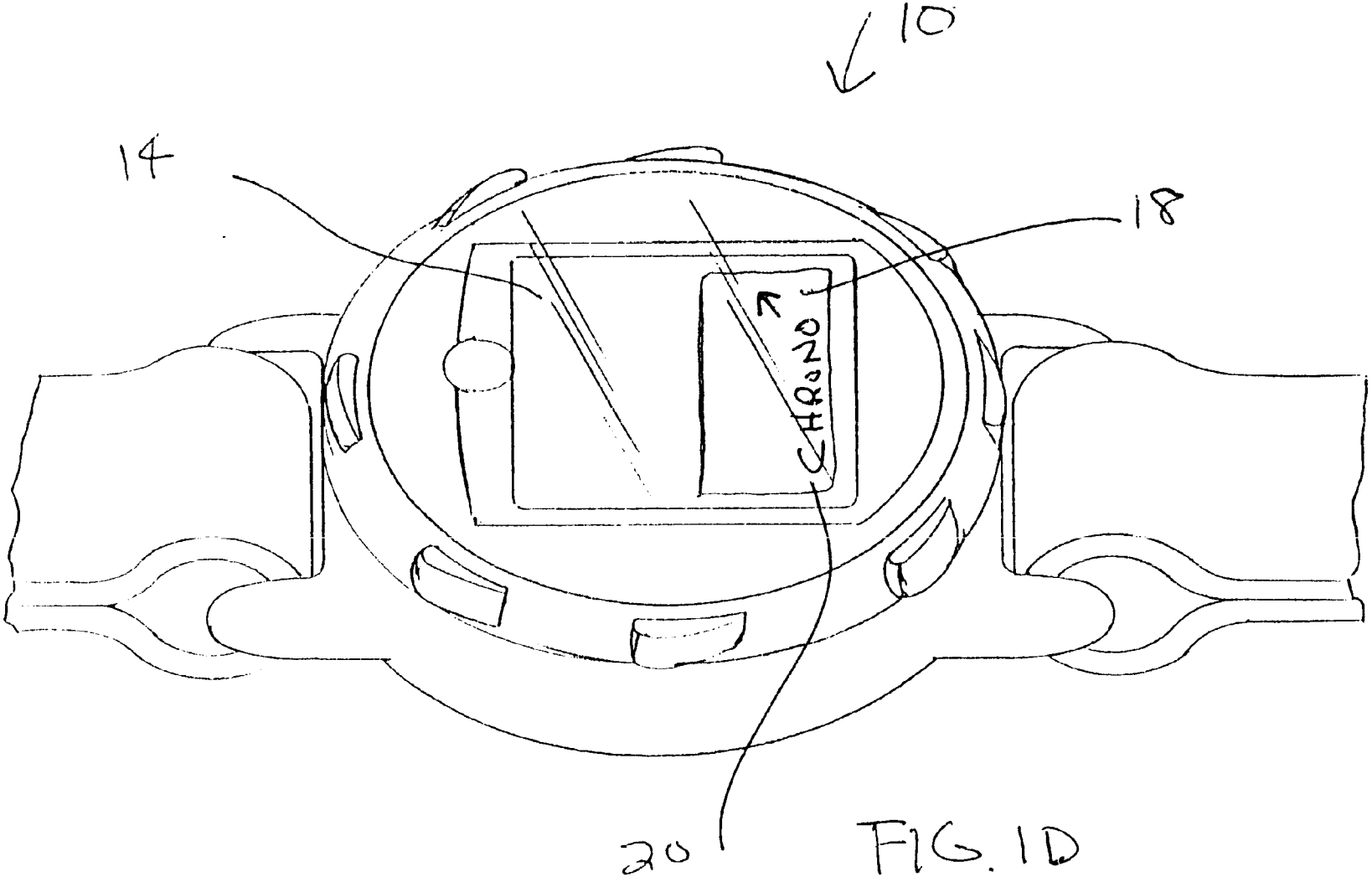
Figure 1E:
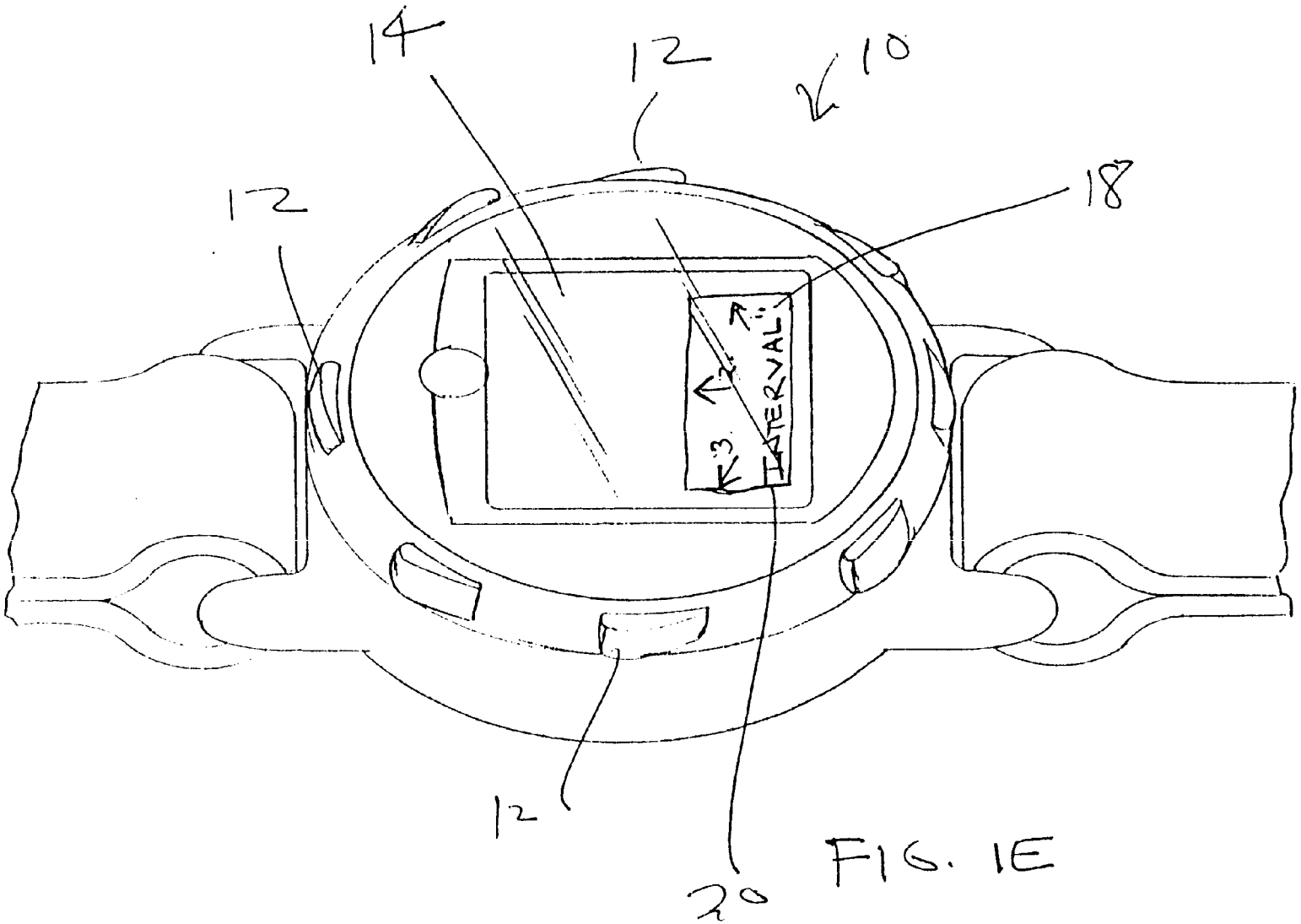

Referring to FIG. 1D, there is depicted a programming or prompt screen with a programming window 18 within watch face 14. The programming window 18 automatically prompts the user through the complete set-up and operation of the unit without the need for using the unit's operating manual. The programming window 18 has two key components: first, the function line 20, identified by "CHRONO" in FIG. 1D, and, second, the indicator arrow(s) 22 identified by the arrow symbol in FIG. 1D. The function line 20 tells the user where he/she is in the programming process, that is, what unit function is being programmed or prompted for. The user may scroll through unit functions, by, for example, pressing the Option Key. The indicator arrow(s) 22 tells the user which key to push next. During use, every programming or prompt screen has a programming window 18 with a function line 20 at the bottom and (an) indicator arrow(s) 22 pointing to the next key(s) to push. For some functions, especially more complex functions, several keystrokes in a specified order may be necessary in order to obtain the desired function. In FIG. 1E, for example, there is depicted a programming screen with "INTERVAL" in the function line 20 and a series of 3 indicator arrows 22 in programming window 18. The arrows 22 have accompanying numbers 1, 2 and 3 which indicate in what sequence the keys 12 pointed to are to be pressed, first, the "1" arrow key, then the "2" arrow key, etc. All the user has to do is watch the window and press the key(s) indicated for the desired function.

The indicator arrow(s) 22 amount to basic commands in the programming window 18. Arrow(s) 22 may be accompanied by other command statements, or other command statements may appear even without indicator arrow(s) 22. Some other command statements may be:

HOLD—Continue to press the current key unless another key is pointed to;

ADJ—Change the digits while programming the display. (Note: Holding the ADJ key down will fast advance the digits);

SET—Set the digits in the current display into memory and advance to programming the next segment;

MEM—Recall memory;

CLR—Clear memory;

NEXT—Proceed to the next memory playback segment;

END—End the current memory playback session.

Figure 2A:
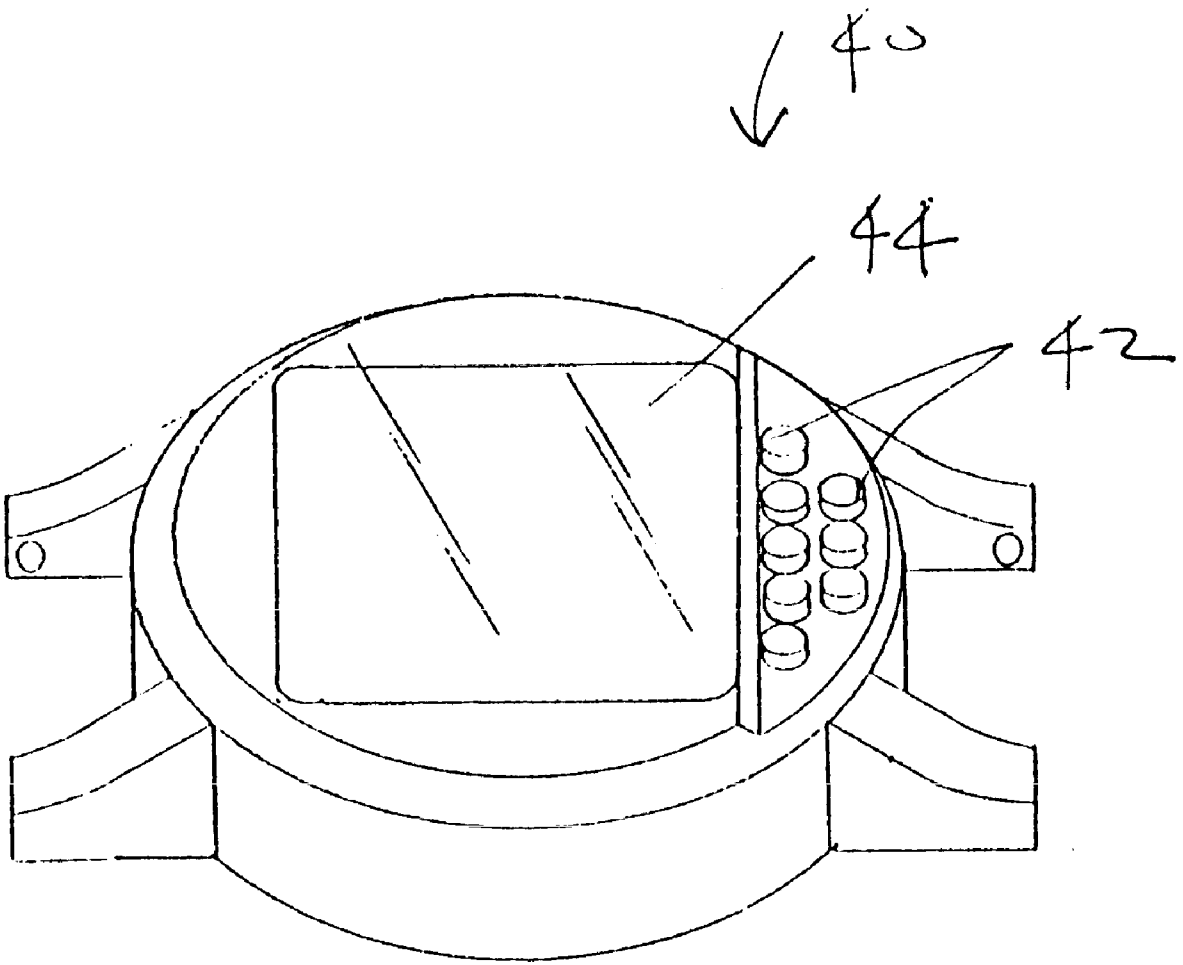
FIGS. 2A and 2B are schematic, perspective depictions of another embodiment of the invention in two different operation modes.
Figure 2B:
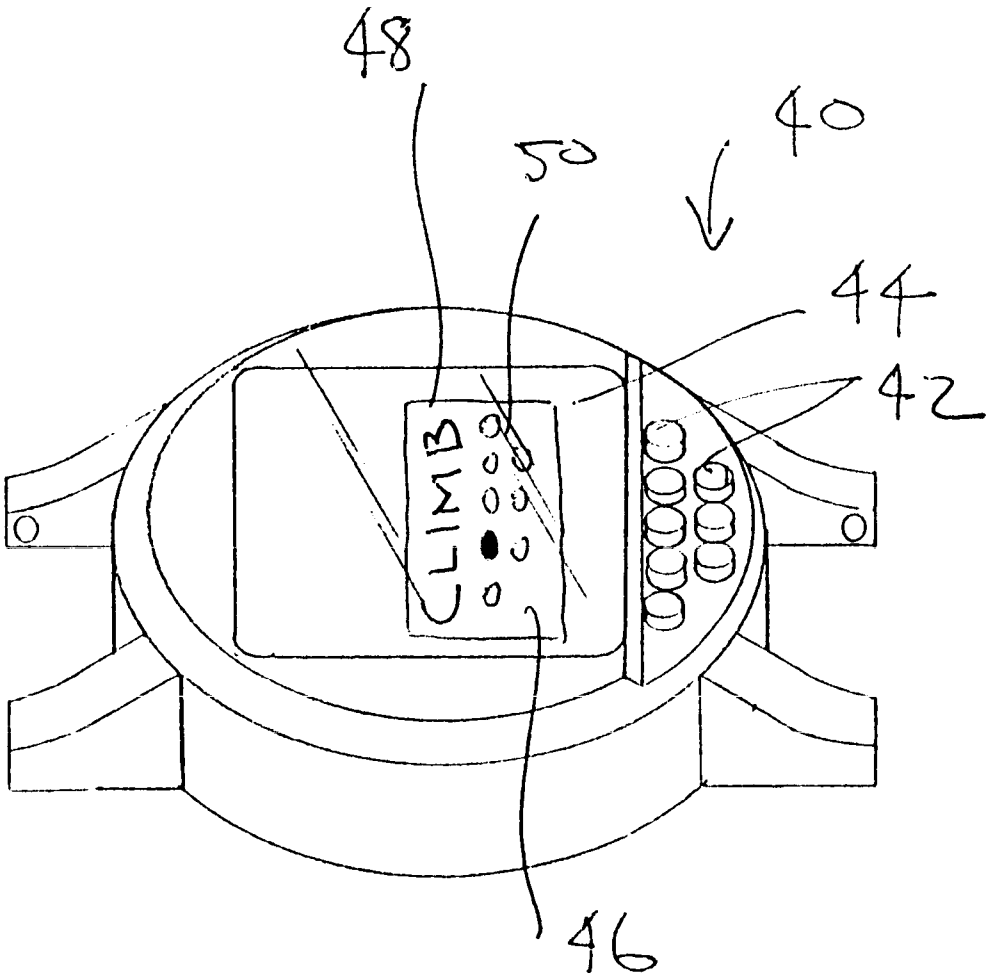

Referring to FIG. 2A, there is depicted a different embodiment, altimeter 40, of the invention. Altimeter 40 has operating keys 42, in this case 8 keys, arranged in a group near the bottom edge of the altimeter face 44. These keys may have primary and secondary functions and names conceptually similar to the keys identified for the embodiment of FIGS. 1A–1E described above. In this altimeter 40 embodiment, a programming or prompt screen with a programming window 46 within altimeter face 44 is provided as depicted in FIG. 2B. Programming window 46 also has two key components. First, the function line 48, identified by "CLIMB" in FIG. 2B; and second, an indicating keypad 50 which is a graphic copy of the group of operating keys 42. Indicating keypad 50 has in this case one key blacked-out, which indicates, like the indicator arrow(s) 22 in the embodiment depicted in FIGS. 1A–1E, that this is the next key to press. Likewise, a series of keys on keypad 50 may be blacked-out with the unit's operating instructions being that the plurality of blacked out keys are pressed in the order of top row first, left-to-right, bottom row second, left-to-right, for example.

The components of this invention may be made by conventional techniques from conventional materials in the consumer electronics industry. Likewise, unit features and their operating programs may be selected from conventional sources or custom-developed as the desire may be.

Although this invention has been described above with reference to particular means, materials and embodiments, it is to be understood that the invention is not limited to these disclosed particulars, but extends instead to all equivalents within the scope of the following claims.

What is claimed is:

1. A body-worn instrument comprising:

an instrument face with a perimeter, a plurality of operating keys dispersed around the outside of, but near, said perimeter; and a programming screen within said instrument face, said programming screen having a display wherein a function of the instrument is selectively displayed in a dot matrix display, and an indicator arrow also in said dot matrix display pointing to one of said operating keys, wherein the instrument is programmed so that the function displayed is being prompted for, and the indicator arrow tells which key to push next.

* * * * *